US010420974B2

(12) United States Patent
Henninger

(10) Patent No.: US 10,420,974 B2
(45) Date of Patent: Sep. 24, 2019

(54) EXERCISE DEVICE

(71) Applicant: William Henninger, Columbus, OH (US)

(72) Inventor: William Henninger, Columbus, OH (US)

(73) Assignee: COULTER VENTURES, Columbus, OH (US)

( * ) Notice: Subject to any disclaimer, the term of this patent is extended or adjusted under 35 U.S.C. 154(b) by 0 days.

(21) Appl. No.: 14/319,663

(22) Filed: Jun. 30, 2014

(65) Prior Publication Data

US 2015/0011370 A1 Jan. 8, 2015

Related U.S. Application Data

(60) Provisional application No. 61/842,438, filed on Jul. 3, 2013.

(51) Int. Cl.

| | |
|---|---|
| ***A63B 23/02*** | (2006.01) |
| ***A63B 21/00*** | (2006.01) |
| *A63B 17/00* | (2006.01) |
| *A63B 71/02* | (2006.01) |

(52) U.S. Cl.

CPC .... *A63B 21/00047* (2013.01); *A63B 23/0211* (2013.01); *A63B 23/0233* (2013.01); *A63B 17/00* (2013.01); *A63B 21/4029* (2015.10); *A63B 2071/025* (2013.01); *A63B 2208/0252* (2013.01); *A63B 2208/0257* (2013.01); *A63B 2225/09* (2013.01)

(58) Field of Classification Search

CPC ..... A63B 23/0211; A63B 17/00; A63B 21/00047; A63B 21/4029; A63B 21/4039; A63B 23/0233; A63B 2071/025; A63B 2208/0252; A63B 2208/0257; A63B 2225/09

See application file for complete search history.

(56) References Cited

U.S. PATENT DOCUMENTS

| | | | | |
|---|---|---|---|---|
| 3,134,592 A * | 5/1964 | Sharkey | A63B 23/0211 | 482/140 |
| 3,567,218 A * | 3/1971 | Johnson | A63B 23/0211 | 482/140 |
| 3,682,475 A * | 8/1972 | Walker | A63B 23/0211 | 482/140 |
| 4,116,434 A * | 9/1978 | Bernstein | A63B 21/1645 | 482/140 |
| 4,185,816 A * | 1/1980 | Bernstein | A63B 21/1645 | 482/140 |
| 4,210,322 A * | 7/1980 | Pritchard | A63B 21/00047 | 446/216 |

(Continued)

OTHER PUBLICATIONS

Roy (https://www.youtube.com/watch?v=tdTWB0Wguxl, published Mar. 27, 2011, last visited Aug. 15, 2017).*

(Continued)

*Primary Examiner* — Joshua Lee

(74) *Attorney, Agent, or Firm* — Vorys, Sater, Seymour and Pease LLP; William L. Klima

(57) ABSTRACT

A glute ham developer (GHD) exercise device including a vertical post and horizontal beam. The exercise device can be a stand alone exercise device, or can include a connector for connecting the exercise device to another exercise device or exercise station.

24 Claims, 17 Drawing Sheets

(56) References Cited

U.S. PATENT DOCUMENTS 4,286,782 A * 9/1981 Fuhrhop ..... A63B 21/078 482/103
4,398,713 A * 8/1983 Ellis ..... A63B 23/0211 482/145
4,515,361 A * 5/1985 Melillo ..... A63B 23/0211 482/140
4,542,900 A * 9/1985 Ray ..... A63B 23/0494 482/101
4,669,724 A * 6/1987 Matheisen ..... A61H 1/0218 482/145
4,679,788 A * 7/1987 Adler ..... A63B 21/0615 482/108
4,830,367 A 5/1989 Foran
4,848,740 A * 7/1989 VanDerHoeven ... A63B 21/154 482/133
4,884,804 A * 12/1989 Fenwick ..... A63B 23/0211 482/140
5,106,083 A * 4/1992 Hall ..... A63B 21/00047 482/141
5,135,459 A * 8/1992 Perry, Jr. ..... A63B 21/00047 482/144
5,263,919 A * 11/1993 Hollenback ..... A63B 21/00047 482/142
5,306,220 A 4/1994 Kearney
5,433,220 A * 7/1995 Kostich ..... A61B 6/0421 5/622
D369,841 S * 5/1996 Yang ..... D21/687
5,570,957 A 11/1996 Kuly et al.
5,584,786 A * 12/1996 Almeda ..... A63B 21/00047 482/140
5,623,949 A * 4/1997 Kostich ..... A61B 6/0421 128/845
5,935,050 A * 8/1999 Shahan ..... A63B 23/0211 482/140
6,030,325 A * 2/2000 Ottoson ..... A61H 1/0218 482/144
6,231,487 B1 * 5/2001 Diamond, Jr. ..... A63B 21/026 482/121
6,254,517 B1 * 7/2001 Kennedy ..... A63B 21/04 482/121
6,468,188 B1 * 10/2002 Koenig ..... A63B 21/0615 482/137
6,692,418 B2 * 2/2004 Shahan ..... A63B 23/02 482/143
7,172,540 B2 * 2/2007 Nguyen ..... A63B 23/0211 482/140
7,384,383 B2 * 6/2008 Forcillo ..... A63B 21/0615 482/140
7,637,851 B1 * 12/2009 Lormil ..... A63B 23/12 482/141
D613,804 S * 4/2010 Perez ..... D21/691
7,691,042 B2 * 4/2010 Pandozy ..... A63B 23/0211 482/142
8,007,414 B2 * 8/2011 Riney ..... A63B 21/0615 482/137
D685,867 S * 7/2013 Mehlman ..... D21/687
8,491,450 B2 * 7/2013 Perry, Jr. ..... A61H 1/0218 482/142
8,632,445 B2 * 1/2014 Kim ..... A63B 21/4035 482/140
9,119,984 B2 * 9/2015 Littell ..... A63B 26/00
9,192,801 B1 * 11/2015 Gouloubev ..... A63B 21/00047
9,259,604 B2 * 2/2016 Miller, Jr. ..... A63B 21/068
D803,958 S * 11/2017 Clark ..... D21/687
10,130,838 B2 * 11/2018 Murrell ..... A63B 23/0211
10,226,665 B2 * 3/2019 Kordecki ..... A63B 21/4047
2001/0034289 A1 * 10/2001 Parrillo ..... A63B 23/035 482/94
2002/0119872 A1 * 8/2002 Greenheck ..... A63B 21/072 482/93
2002/0128131 A1 9/2002 Wu
2005/0107225 A1 * 5/2005 Diamond, Jr. ..... A63B 23/0211 482/105
2005/0159279 A1 * 7/2005 Stangler ..... A63B 21/00047 482/148
2006/0116262 A1 * 6/2006 Pandozy ..... A63B 23/0211 482/142
2007/0072749 A1 * 3/2007 Lay ..... A63B 21/06 482/94
2007/0197360 A1 * 8/2007 Rester ..... A61H 1/02 482/23
2007/0298948 A1 * 12/2007 Chen ..... A61H 1/0218 482/144
2008/0051273 A1 * 2/2008 Storch ..... A63B 21/00047 482/141
2008/0096744 A1 * 4/2008 Perry, Jr. ..... A61H 1/0218 482/144
2009/0264265 A1 * 10/2009 Contreras ..... A63B 21/00047 482/99
2012/0058870 A1 3/2012 Contreras
2012/0208682 A1 * 8/2012 Kueckelhan ..... A63B 23/0211 482/131
2012/0295780 A1 * 11/2012 Chou ..... A63B 23/12 482/142
2014/0066276 A1 * 3/2014 Hornback ..... A63B 21/068 482/145

OTHER PUBLICATIONS

XMark (https://www.youtube.com/watch?v=v4lzhCs5JS4, published Oct. 27, 2010, last visited Aug. 15, 2017).*
XMark (https://www.youtube.com/watch?v=v4lzhCs5JS4, published Oct. 27, 2010, last visited Mar. 5, 2018.*
https://www.youtube.com/watch?v=ZFOQZ8Aze_A, published Apr. 13, 2013, last visited Mar. 5, 2015.*
Roy (https://www.youtube.com/watch?v=tdTWB0Wguxl, published Mar. 27, 2011, last visited Mar. 5, 2018).*
XMark (https://www.youtube.com/watch?v=v4lzhCs5JS4, published Oct. 27, 2010, last visited Sep. 4, 2018).*
Yukon (https://www.youtube.com/watch?v=ZFOQZ8Aze_A, published Apr. 13, 2013, last visited Mar. 5, 2015).*
EP Application No. 14 175 555.3 Search Report dated Nov. 20, 2014.

* cited by examiner

EXERCISE DEVICE

RELATED APPLICATION(S)

This application is a Non-Provisional application, which claims benefit under 35 U.S.C. 119(e) of U.S. Provisional Application No. 61/842,438, filed Jul. 3, 2013, the content of which is hereby incorporated by reference in its entirety.

FIELD

An exercise device, in particular an exercise device configured to strengthen the hamstring and gluteus, for example, a Glute Ham Developer (GHD).

BACKGROUND

In the past, there has existed various weight lifting equipment for exercising and developing various muscles and muscle groups of the body. However, there is a continuing need for new types and configurations of exercise equipment for exercising and developing specific portions of the body, for example, to strengthen the hamstring and gluteus.

SUMMARY

An improved exercise device.

An improved exercise device configured to strengthen the hamstring and gluteus.

An improved glute ham developer (GHD) exercise device.

A glute ham developer (GHD) exercise attachment device.

A glute ham developer (GHD) exercise device comprising or consisting of a vertical post connected to a horizontal beam.

A glute ham developer (GHD) exercise attachment device comprising or consisting of a vertical post connected to a horizontal beam.

A glute ham developer (GHD) exercise attachment device comprising or consisting of a vertical post connected to a horizontal beam, and a connector configured to connect the exercise attachment device to another support such as an exercise device, for example, a rig or rack.

A glute ham developer (GHD) exercise attachment device comprising or consisting of a vertical post connected to a horizontal beam, the horizontal beam comprising a connector configured to connect the horizontal beam to another support such as an exercise device, for example, a rig or rack.

A glute ham developer (GHD) exercise device comprising or consisting of a vertical post, one or more pads supported by the vertical post, and a horizontal beam connected to the vertical post.

A glute ham developer (GHD) exercise attachment device comprising or consisting of a vertical post, one or more pads supported by the vertical post, a horizontal beam connected to the vertical post, and a connector configured to connect the exercise attachment device to another support such as an exercise device, for example, a rig or rack.

A glute ham developer (GHD) exercise device comprising or consisting of a first vertical post, one or more pads supported by the first vertical post, a horizontal beam connected to the vertical post, a second vertical post connected to the horizontal beam, and one or more foot pegs connected to the second vertical post.

A glute ham developer (GHD) exercise attachment device comprising or consisting of a first vertical post, one or more pads supported by the first vertical post, a horizontal beam connected to the vertical post, a second vertical post connected to the horizontal beam, one or more foot pegs connected to the second vertical post, and a connector configured to connect the exercise attachment device to another support such as an exercise device, for example, a rig or rack.

An exercise device comprising or consisting of a glute ham developer (GHD) exercise device connected to another exercise device such as a rig or rack.

An exercise device comprising or consisting of a glute ham developer (GHD) exercise device, another exercise device such as a rig or rack, and a connector configured to connect the glute ham developer (GHD) exercise device to the another exercise device such as a rig or rack.

The exercise device is configured to strengthen the ham string and gluteus. For example, the exercise device is a glute ham developer (GHD) exercise device.

For example, the glute ham developer (GHD) exercise device can be a stand alone glute ham developer (GHD) exercise device. As another example, the glute ham developer (GHD) exercise device can be an exercise attachment device configured to be attached to another support such as a post connected to a floor, wall, and/or ceiling, or another exercise device (another piece of exercise piece of equipment). As a further example, the exercise device comprises glute ham developer (GHD) exercise device connected together or integrated together with other exercise equipment or exercise equipment stations (e.g. exercise rig, rack, and stand).

The glute ham developer (GHD) exercise device, for example, can comprise or consist of a first vertical post connected to an upper first horizontal beam and lower second horizontal beam. The first horizontal beam and second horizontal beam can be oriented transversely relative to a length of the glute ham developer (GHD) exercise device. A support pad, for example, a split pad can be connected to and supported on top of the first horizontal post. For example, the first horizontal beam, oriented transverse relative to a length of the exercise device, is connected to an upper end of the first vertical post (e.g. by welding or bolting), and a pair of split pads are supported by the first horizontal beam. The split pads and first horizontal beam can be configured so that the split pads can be moved or adjusted closer together or further apart to accommodate a particular user. The support pad or split pad, for example, can be cylindrical-shaped (e.g. partial or one-half cylinder-shaped) with the round side facing upwardly. The second horizontal beam is connected (e.g. bolted or welded) to a bottom end of the first vertical post. The second horizontal beam is oriented transversely relative to a length of the exercise device to provide stability (e.g. ends acting like outriggers).

A third horizontal beam is connected to the first vertical post (e.g. by welding or bolting). A second vertical post is connected to the first horizontal beam. For example, the second vertical post is connected to the third horizontal beam in a manner to allow the second vertical post to be moved (e.g. slid on third horizontal beam) or adjusted closer to or further away from the first vertical post or split pads to accommodate the leg lengths of a particular user. For example, a lower end of the second vertical post is connected (e.g. bolted or welded) to a slider (e.g. section of box beam) configured to be supported by or surrounding the second horizontal beam. For example, the slider is fitted with a locking pin to cooperate with one of a series of holes provided along a length of the third horizontal beam to allow adjustment of the slider along the third horizontal beam and locking same into a selected position.

The second vertical post, for example, is fitted with an ankle grip device. The ankle grip device, for example, can be provided by one or more ankle pegs. For example, a horizontal transversely oriented shaft is fitted through a hole in the vertical post and connected thereto (e.g. by bolting or welding). The shaft can be centered on the second vertical post providing opposed ends extending outwardly from the second vertical post. A pair of ankle pads (e.g. cylindrical-shaped pads) are provided on the opposed ends of the horizontal shaft, and configured to rotate. Another horizontal transverse oriented shaft with a pair of ankle pads can be provided at a different height on the second vertical post relative to the other horizontal shaft. The two shafts and respective pairs of ankle pads together being configured to grip and restrain the ankles of a user during use of the exercise device.

The third horizontal beam is connected to one end to the first vertical post, and can be connected at an oppose end to another support. For example, the support can be a post, for example, supported on or connected to a floor, wall, and/or ceiling. Alternatively, the support can be a part or component of another exercise device or combined exercise device. For example, the another exercise device can be a rig or rack, in particular an exercise rig or rack. For example, the rig can comprise multiple posts connected together by beams, joists, or other suitable structure connecting together the posts into an integrated rig structure. As another example, the rack can comprise posts connected together by beams, joists, or other suitable structure, and configured to hold, store, or otherwise support weights, in particular free weights.

The glute ham developer (GHD) exercise device can comprise a connector for connecting the exercise device to another exercise device such as a rig or rack. For example, a free end of the third horizontal beam is provided with a connector. The connector, for example, is configured to connect to a vertical post of the rig or rack. For example, the connector is a slider connected (e.g. bolted or welded) to the free end of the third horizontal beam. The position of the slider can be adjusted up or down the post for example, to place the third horizontal beam in a level horizontal position, and then lock same into position. For example, the slider is section of box beam or a U-shaped channel provided with a removable locking pin that passes through a pair of holes in the box beam or U-shaped channel and a cooperating pair of respective holes in the vertical post of the rig or rack. The vertical post of the rig or rack is provided with multiple pairs of spaced apart holes at different heights to allow height adjustment of the slider and respectively the height of the free end of the third horizontal beam.

BRIEF DESCRIPTION OF DRAWINGS

The glute ham developer (CHD), for example, can be configured or arranged wherein the first vertical post, the second vertical post, the third vertical post, and the third horizontal beam are located in a same center vertical plane oriented along the center horizontal longitudinal axis of the device, and wherein the first horizontal beam, the second horizontal beam, and the first vertical post are located in a same vertical plane oriented transversely relative to the center horizontal longitudinal axis of the device.

DETAILED DESCRIPTION

Figure 1:
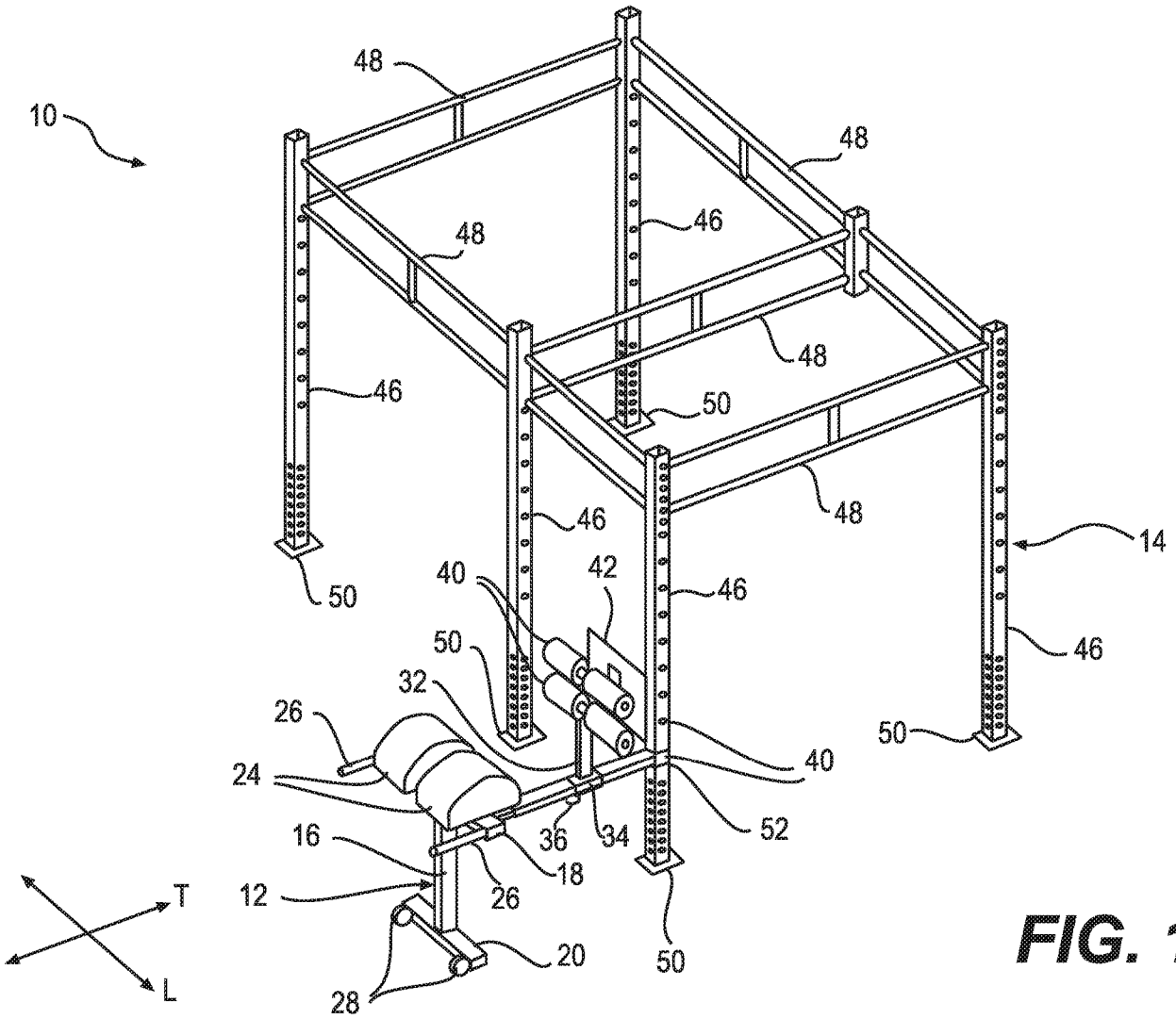
FIG. 1 is a perspective view of an exercise device.
Figure 2:
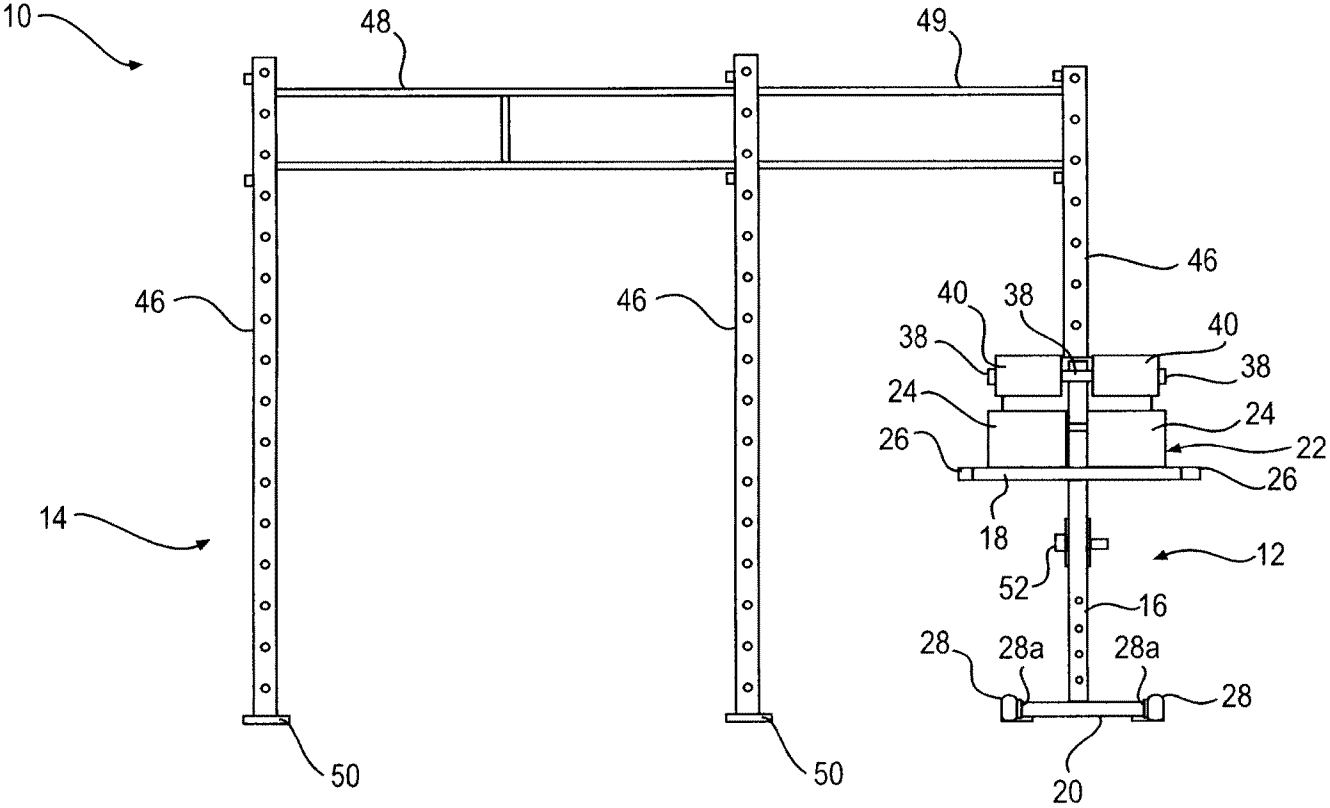
FIG. 2 is a front elevational view of the exercise device shown in FIG. 1.
Figure 3:
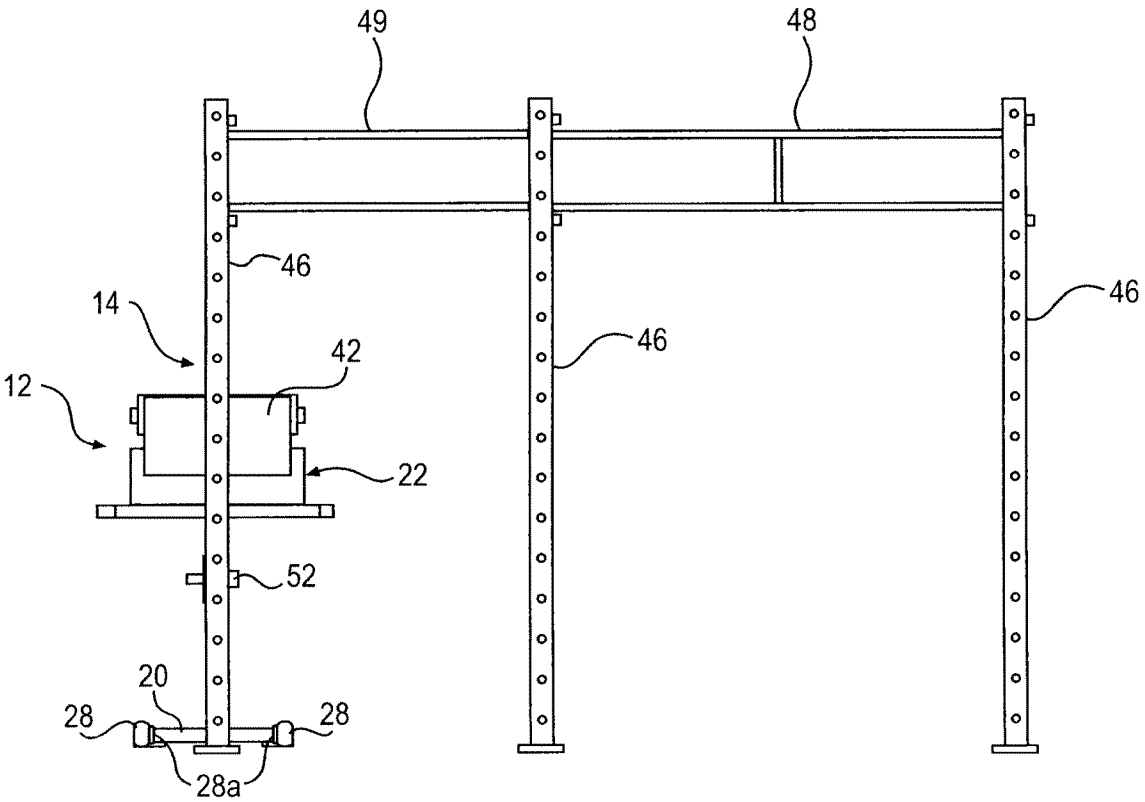
FIG. 3 is a rear elevational view of the exercise device shown in FIG. 1.
Figure 4:
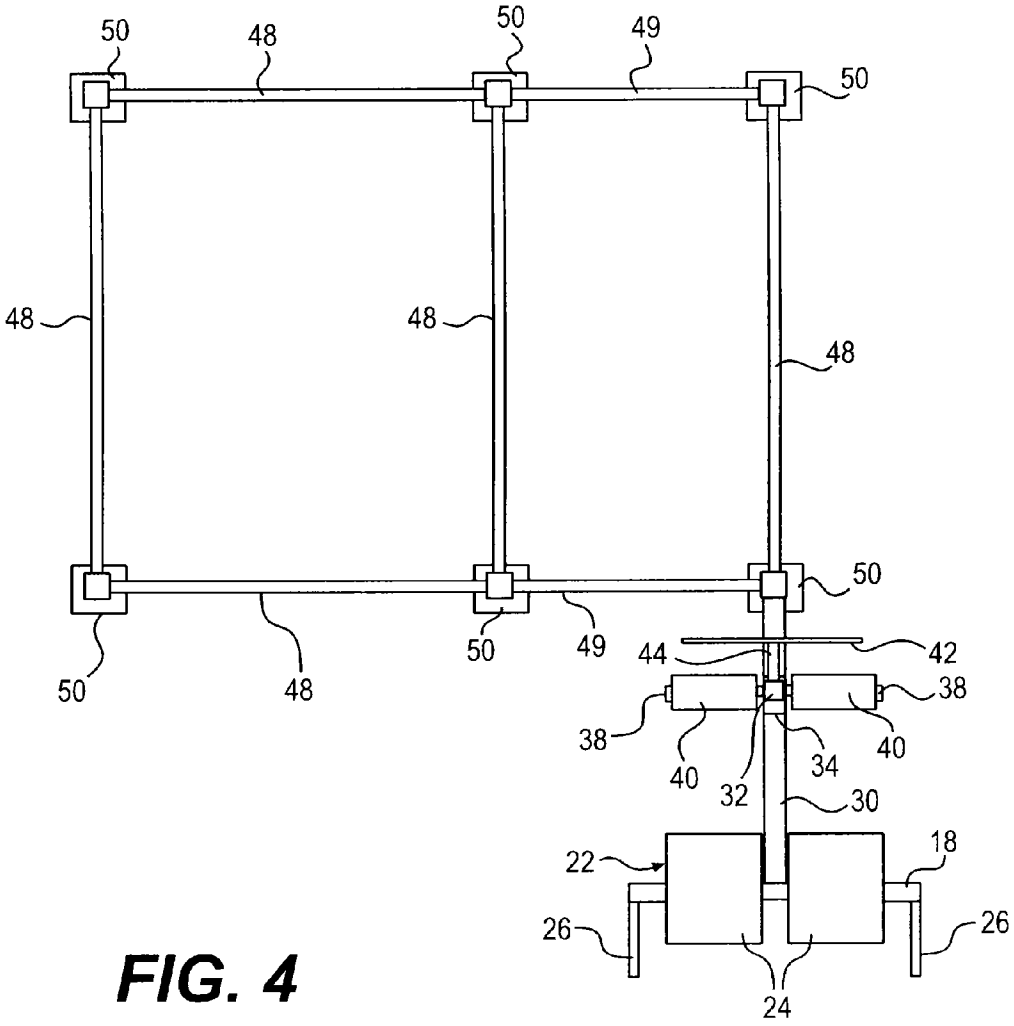
FIG. 4 is a top planar view of the exercise device shown in FIG. 1.
Figure 5:
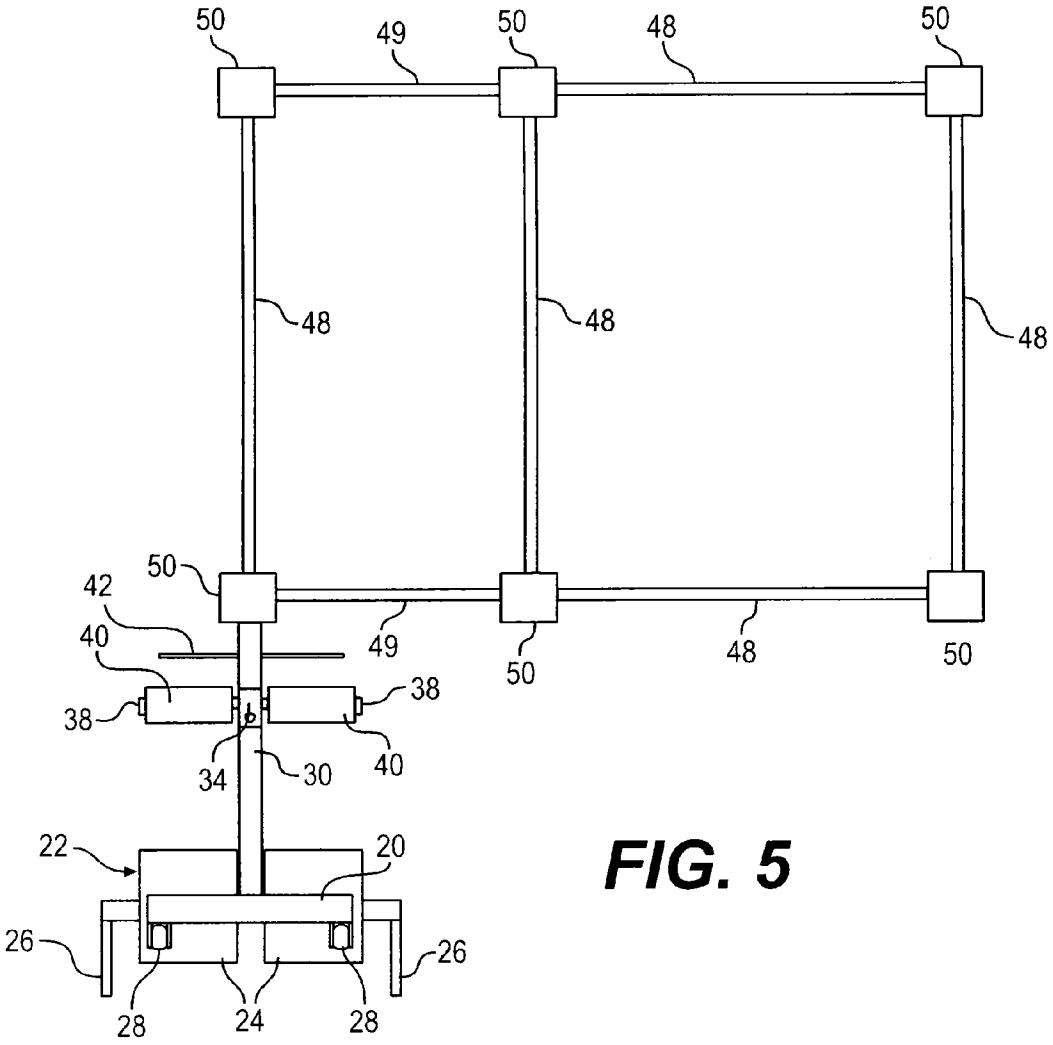
FIG. 5 is a bottom planar view of the exercise device shown in FIG. 1.
Figure 7:
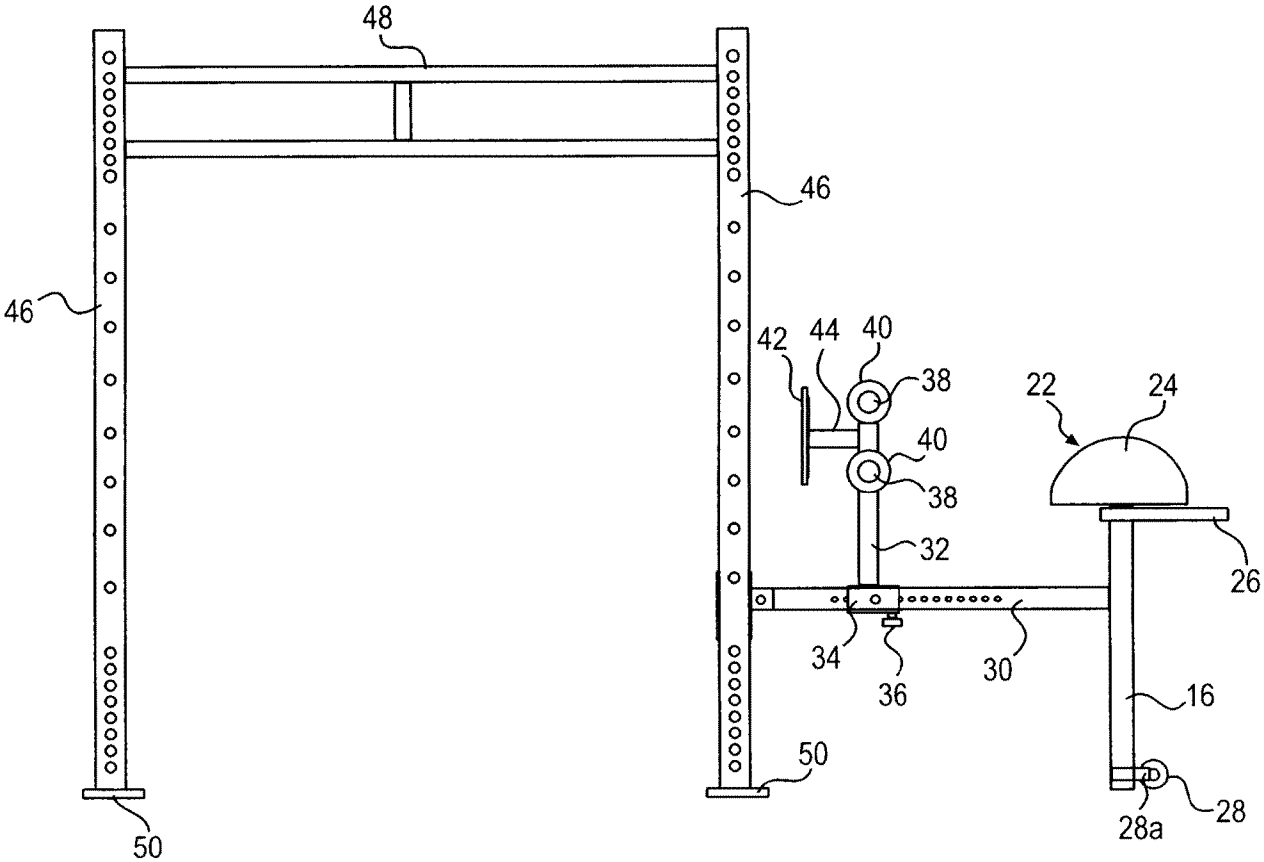
FIG. 7 is an opposite side elevational view of an exercise device shown in FIG. 1.

An exercise device 10 is shown in FIGS. 1 and 7. The exercise device 10 comprises or consists of a glute ham developer (GHD) exercise device 12 connected to a rig exercise device 14. The glute ham developer (GHD) exercised device 12 and rig exercise device 14 are shown integrated together as a single exercise unit when assembled together. As shown in FIG. 1, the exercise device has a longitudinal axis L and a transverse axis T.

The glute ham developer (GHD) exercise device 12 comprises a first vertical post 16. A first horizontal beam 18 is connected (e.g. bolted, welded and/or fastened) to an upper end of the first vertical post 16, and oriented transversely relative to a length of the glute ham developer (GHD) exercise device 12. A second horizontal beam 20 is connected (e.g. bolted, welded, and/or fastened) to a lower end of the first vertical post 16, and oriented transversely relative to a length of the glute ham developer (GHD) exercise device 12. The ends of the second horizontal beam 20 serve as outriggers for stabilizing the glute ham developer (GHD) exercise device 12 on the floor.

A support cushion, for example, a split cushion 22 is connected to and supported on top of the first horizontal beam 18. The split cushion 22 comprises a pair of split cushions 24, 24 separated apart a distance. The split cushions 24, 24 each have a half-round side profile, and a flat portion of each split cushions 24, 24 is supported by the first horizontal beam. The first horizontal beam 18 supports a center location of each split cushion 24. The bottom of each split cushion 24, 24 is provided with a slider (not shown) cooperating with the first beam 18, and each having a locking pin (not shown) to allow the split cushions 24, 24 to be adjusted further apart or closer together. The locking pins cooperate with one of a series of holes (not shown) provided in the first horizontal beam 18 to change or adjust the position and separation distance of the split cushions 24, 24 along the length of the first horizontal beam 18.

The body engaging support cushion has a curved or rounded upper surface. For example, the semicylinder-shaped support cushion 24 includes a flat base supported by the first horizontal beam 18 (FIG. 8), a half cylinder surface facing upwardly, and flat ends. A pair of handles 26, 26 are connected (e.g. bolted, welded, fastened) to the first horizontal beam 18, and extend outwardly in front of the glute ham developer (GHD) exercise device 12. The pair of handles 26, 26 can be oriented horizontally as shown.

A pair of rollers 28, 28 are fitted to the second horizontal beam 20 by trunnion arrangement 28A (e.g. pair of plates and axle supporting the rollers 28, 28) to allow moving the glute ham developer (GHD) exercise device 12. The rollers 28, 28 are configured to not be in contact with the floor when the exercise device is operational, for example, by being located a distance off the floor on the second horizontal beam. For example, when the glute ham exercise device 12 is separated from the rig exercise device 14, the glute ham exercise device can be tilted at an angle to place the rollers 28, 28 in contact with the floor to allow the rollers 28, 28 to become operational to roll the glute ham developer (GHD) exercise device 12.

The glute ham developer (GHD) exercised device 12 also comprises a third horizontal beam 30 connected (e.g. bolted, welded, and/or fastened) to the first vertical post 16. The third horizontal beam 30 is oriented along a horizontal longitudinal axis of the exercise device 10.

A second vertical post 32 is connected to the third horizontal beam 30. For example, the second vertical post 32 is connected in a manner that its position can be adjusted (e.g. by sliding) along a length of the third horizontal beam 30 to move the second vertical post 32 closer to or further away from the first vertical post 16 and split cushion 22 to adjust for the length of the legs of the user. A slider 34 is connected (e.g. bolted, welded, and/or fastened) to a lower end of the second vertical post 32. For example, the slider 34 is made from a section of box beam having inner dimensions the same as or slightly larger than the outer dimensions of the third horizontal beam 30 to allow the slider 34 to slide along the length of the third beam 30. The slider 34 is fitted with a locking pin 36 configured to cooperate with one of a series of holes provided along the length of the third beam 30 to adjust or change the location of the slider 34 and second vertical post 32 on the third beam 30 relative to the first vertical post 16 and split cushion 22.

The second vertical post 32 is fitted with an ankle grip device, for example, comprising a pair of shafts 38 that are spaced apart and located at different heights on the second vertical post 32. For example, the second vertical post 32 is provided with two holes to accommodate the shafts 38, 38, and the shafts are connected (e.g. bolted, welded, and/or fastened) to the second vertical post 32. For example, a center of each shaft is located at the second vertical post 32 with opposite ends extending outwardly therefrom. A pair of cylindrical-shaped cushions 40, 40 are provided on the opposite ends of each shaft 38. The shafts 38, 38 are spaced apart vertically on the second vertical post 32 in a manner to accommodate the ankles of a user between upper and lower sets of the pair of cushions 40, 40.

A foot plate 42 is connected (e.g. bolted, welded, and/or fastened) via a support 44 (e.g. bar, beam, or plate) to the second vertical post 32. The foot plate 42 can be oriented vertically and spaced a predetermined distance from the cushions 40 to accommodate the feet of the user. The first vertical post, second vertical post, and third horizontal beam are located in a center vertical plane of the exercise device.

The first vertical post 16, second vertical post 32, first horizontal beam 18, second horizontal beam 20, and third horizontal beam 30, for example, can be made from sections of box beams (e.g. metal, steel, aluminum, plastic, composite, fiberglass, carbon graphite, Kevlar, or other suitable structural material) connected together by bolting, welding, forming, molding and/or fastening (e.g. using conventional or custom made fasteners and/or connectors).

The rig exercise device 14 comprises spaced apart vertical posts 46 connected together by joist members (e.g. double length joist members 48, regular length joist members 49) located at the upper ends of the vertical posts 46. The vertical posts 46, for example, can be box beams (e.g. made of metal, steel, aluminum, plastic, composite, fiberglass, carbon graphite, Kevlar, or other suitable structural material). The joist members 48, 49, for example, can be made or fabricated of structural components (e.g. metal, steel, composite bars, shafts, rods, plates) connected (e.g. bolted, welded, and/or fastened) together. The joist members 48, 49 are connected (e.g. bolted, welded, and/or fastened) at the upper ends of the vertical posts 46 to assemble the rig exercise device 14.

The vertical posts 46 are provided with foot plates 50 at lower ends thereof for anchoring the vertical posts 46 to the floor. For example, the foot plates 50 can be provided with through holes for bolting and anchoring the foot plates 50 integrated with the vertical posts 46 to the floor.

The glute ham developer (GHD) exercise device 12 can be connected to the exercise rig device 14. For example, the third horizontal beam 30 of the glute ham developer (GHD) exercise device 12 can be bolted, welded, and/or fastened. The fastener, for example, can be a conventional or custom made fastener or connector. The connection can be permanent (e.g. welded), or configured to be assembled and disassembled (e.g. bolted).

Figure 6:
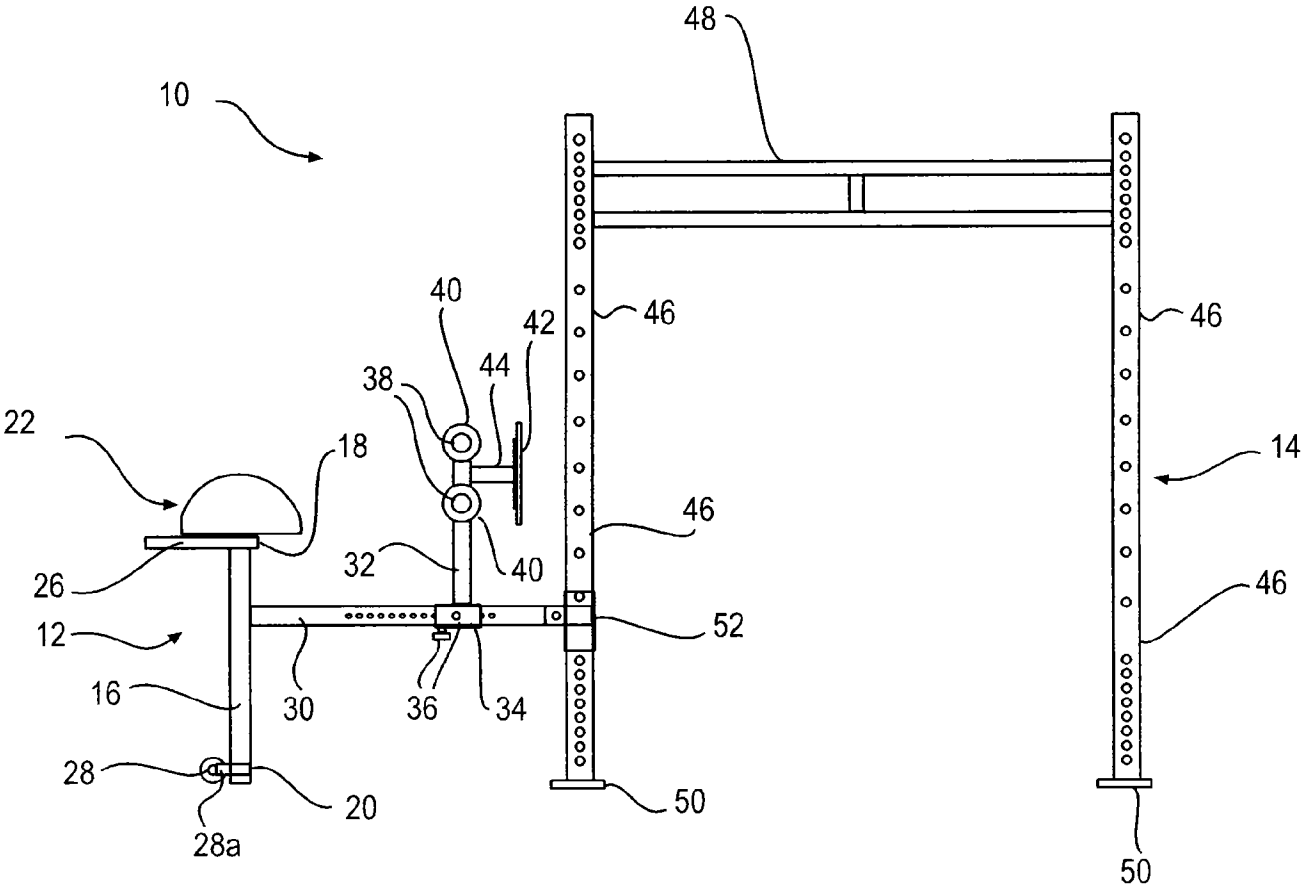
FIG. 6 is a side elevational view of the exercise device shown in FIG. 1
Figure 8:
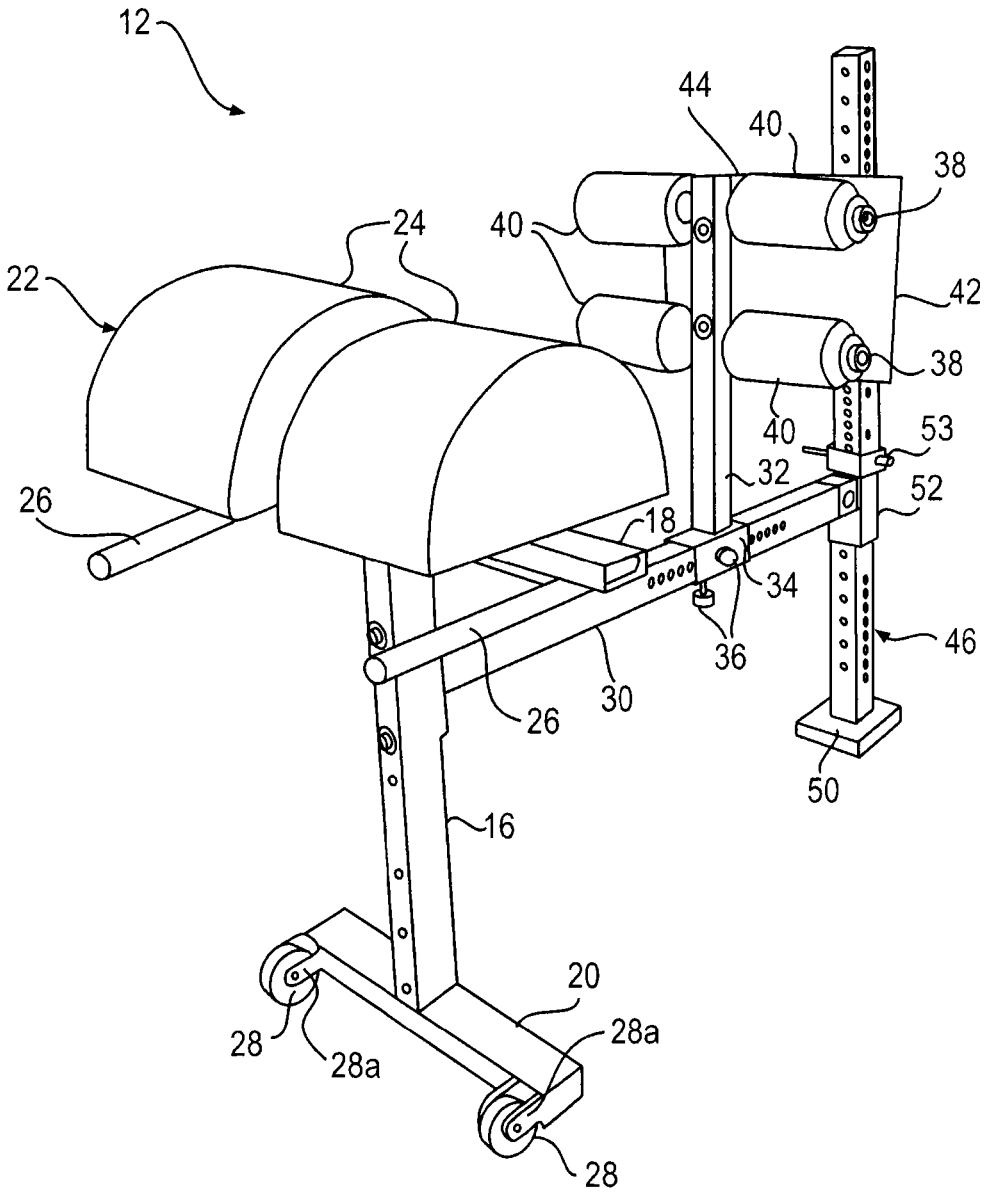
FIG. 8 is a perspective view of an exercise attachment device.
Figure 9:
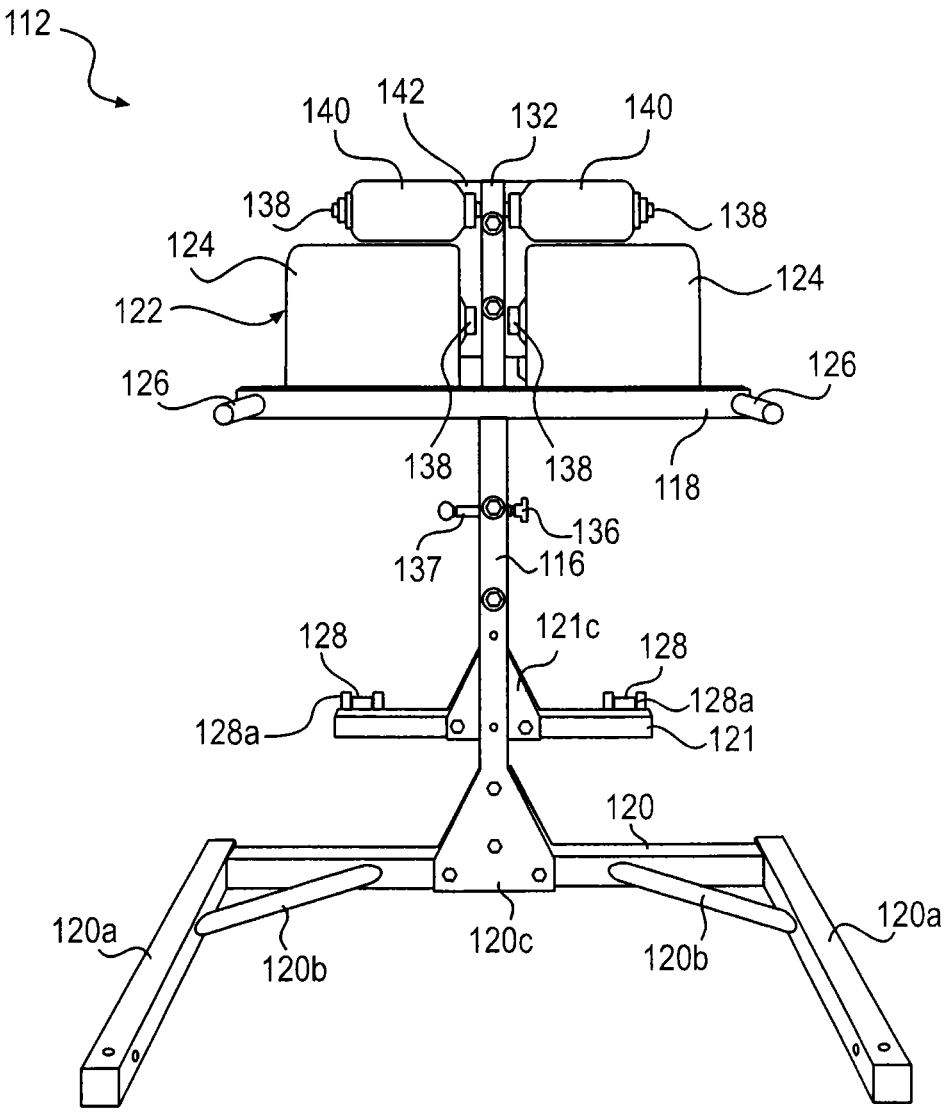
FIG. 9 is a front view of the exercise attachment device shown in FIG. 8.
Figure 10:
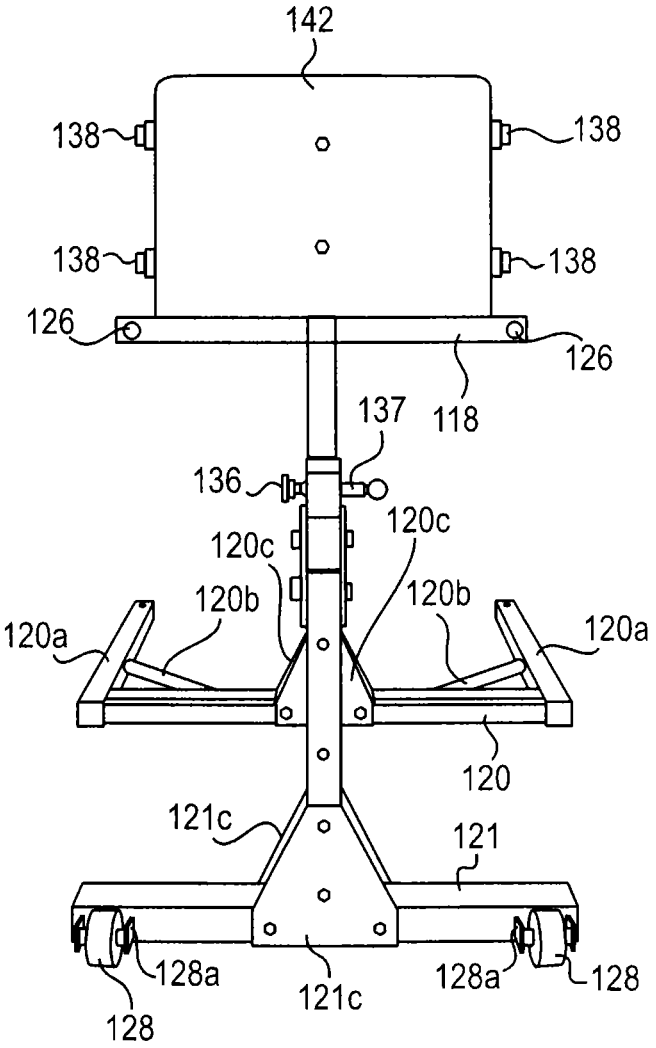
FIG. 10 is a rear view of the exercise attachment device shown in FIG. 9.
Figure 11:
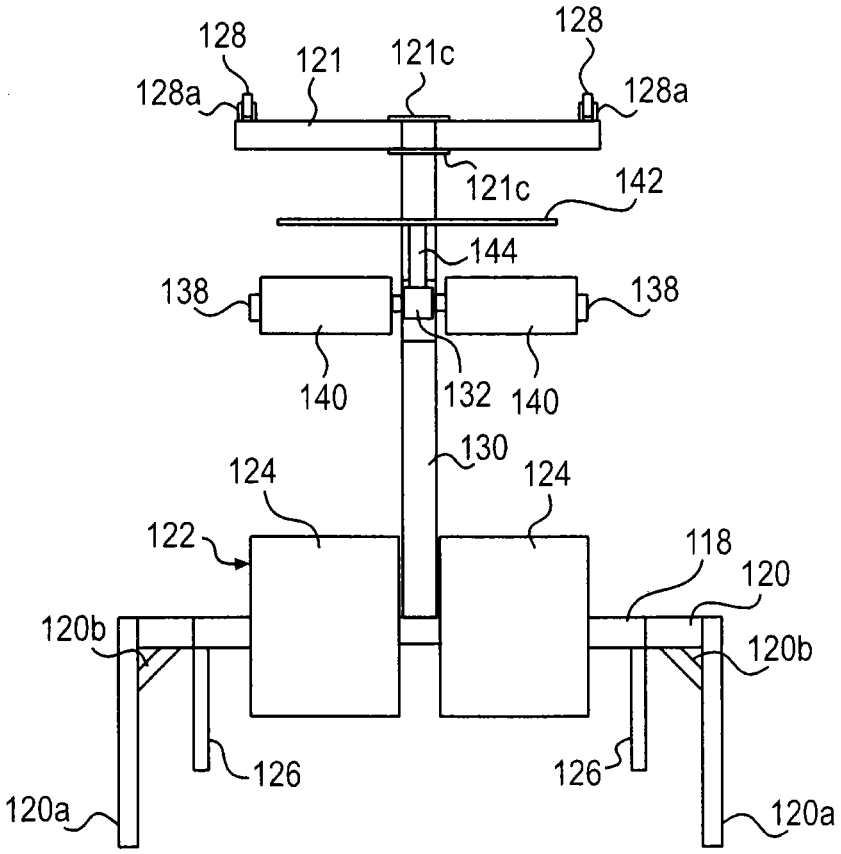
FIG. 11 is a top planar view of the exercise attachment device shown in FIG. 8.
Figure 12:
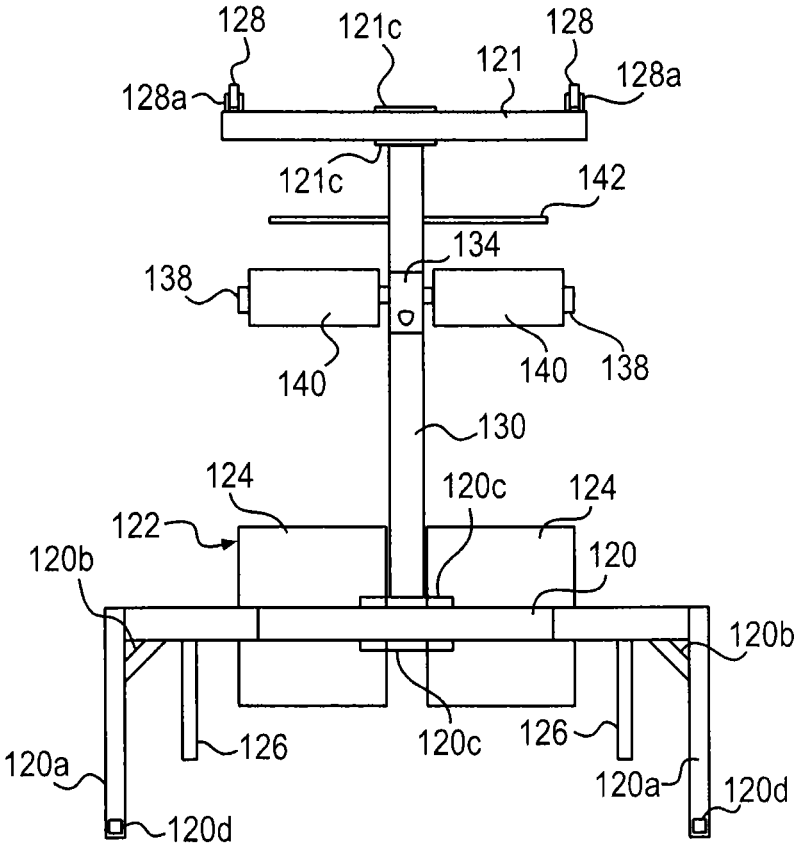
FIG. 12 is a bottom planar view of the exercise attachment device shown in FIG. 8.

For example, a connector 52 is shown in FIGS. 6 and 8. A free end of the third beam 30 of the glute ham developer (GHD) exercise device 12 is fitted or connected to the connector 52. The connector 52, for example, can be a U-shaped bracket or section of box beam providing a slider configured to cooperate with a vertical post 46 of the rig exercise device 14. The connector 52 can be configured to slide up and down on the vertical post 46, and then be lock in position with a removable locking pin 53 (FIG. 8).

The connector 52, for example, can be connected to the free end of the third horizontal beam 30 of the glute ham developer (GHD) exercise device 12. For example, a bolt (FIG. 8) connects the connector 52 to the free end of the third horizontal beam 30.

The locking pin 53 of the connector 53 is configured to cooperate with a selected hole in a series of holes provided on each side of the vertical post 46 along a length thereof (e.g. the holes can be provided along a portion or the entire length of the vertical post 46). This allows the height of the connector 52 to be adjusted. For example, the height of the connector 52 is adjusted so that the third horizontal beam 30 of the glute ham developer (GHD) exercise device 12 is oriented horizontally.

The exercise device 10 can be an integrated exercise unit with the glute ham developer (GHD) exercise device 12 connected to the rig exercise device 14. For example, the exercise device 10 can be an integrated unit with the glute ham developer (GHD) exercise device 12 and rig exercise device 14 assembled together at the same time. Alternatively, the glute ham developer (GHD) can be an accessory that to be later added to an existing already assembled rig exercise device 14.

Stand Alone Glute Ham Developer (GHD) Device

A stand alone glute ham developer (GHD) device 112 is shown in FIGS. 9 thru 14.

The stand alone glute ham developer (GHD) exercise device 112 comprises a first vertical post 116. A first horizontal beam 118 is connected (e.g. bolted, welded and/or fastened) to an upper end of the first vertical post 116, and oriented transversely relative to a length of the glute ham developer (GHD) exercise device 112. A second horizontal beam 120 is connected (e.g. bolted, welded, and/or fastened) to a lower end of the first vertical post 116, and oriented transversely relative to a length of the glute ham developer (GHD) exercise device 112. The ends of the second horizontal beam 120 serve as outriggers for stabilizing the glute ham developer (GHD) exercise device 12 on the floor.

A pair of stabilizer beams 120*a* can be each connected to respective ends of the second horizontal beam 120. The stabilizer beams 120*a* are oriented transversely relative to the second horizontal beam 120, and extend forwardly and outwardly in front of the stand alone glute ham developer (GHD) device 112. A pair of reinforcing members 120*b* are connected between the second beam 120 and each stabilizer beams 120*a* to reinforce the structural connection and the relative orientation therebetween.

A pair of gusset plates 120*c* can connect the second horizontal beam 120 to the first vertical post 116, and reinforce this structural connection.

A split cushion 122 is connected to and supported on top of the first horizontal beam 118. The split cushion 122 comprises a pair of split cushions 124, 124 separated apart a distance. The bottom of each split cushion 124, 124 is provided with a slider (not shown) cooperating with the first horizontal beam 118, and each having a locking pin (not shown) to allow the split cushions 124, 124 to be adjusted further apart or closer together. The locking pins cooperate with one of a series of holes (not shown) provided in the first horizontal beam 118.

A pair of handles 126, 126 are connected (e.g. bolted, welded, and/or fastened) to the first horizontal beam 118, and extend outwardly in front of the glute ham developer (GHD) exercise device 112. The pair of handles 126, 126 can be oriented horizontally. A pair of rollers 120*d* are each fitted to the bottom of each stabilizer beam 120*a* to allow moving the glute ham developer (GHD) exercise device 112. Alternatively, the rollers 120*d* can be replaced with feet (e.g. rubber or plastic resilient gripping feet).

The stand alone glute ham developer (GHD) exercise device 112 also comprises a third horizontal beam 130 connected (e.g. bolted, welded, and/or fastened) to the first vertical post 116.

A second vertical post 132 is connected to the third horizontal beam 130. For example, the second vertical post 132 is connected in a manner that it can be adjusted or slid along a length of the third horizontal beam 130 to move the second vertical post 132 closer to or further away from the first vertical post 116 and the split cushion 122 to accommodate the length of the legs of the particular user. A slider 134 is connected (e.g. bolted, welded, and/or fastened) to a lower end of the second vertical post 132. For example, the slider 134 is made from a section of box beam having inner dimensions the same or slightly larger than the outer dimensions of the third horizontal beam 130 to allow the slider 134 to slide along the length of the third horizontal beam 130. The slider 134 is fitted with a locking pin 136 configured to cooperate with one of a series of holes provided along the length of the third horizontal beam 130 to adjust or change the location of the slider 134 and second vertical post 132 on the third horizontal beam 130.

The second vertical post 132 is provided with an ankle grip device, for example, a pair of shafts 138 that are spaced apart and located at different heights on the second vertical post 132. For example, the second vertical post 132 is provided with two holes to accommodate the shafts 138, 138, and the shafts are connected (e.g. bolted, welded, and/or fastened) to the second vertical post 132. A shafts 138, 138 can be centered on the vertical post 132 to provide opposed ends extending outwardly from the vertical post 132. A pair of cylindrical-shaped cushions 140, 140 can be provided on the ends of the shafts 138, 138.

A foot plate 142 is connected (e.g. bolted, welded, and/or fastened) via a support 144 (e.g. bar, beam, or plate) to the second vertical post 132. The foot plate 142 is oriented vertically and spaced a predetermined distance from the cushions 140.

The first vertical post 116, second vertical post 132, first horizontal beam 118, second horizontal beam 120, and third horizontal beam 130, for example, can be made from sections of box beams (e.g. metal, steel, aluminum, plastic, composite, fiberglass, carbon graphite, Kevlar, or other suitable structural material) connected together by bolting, welding, and/or fastening (e.g. using conventional or custom made fasteners and/or connectors).

Figure 13:
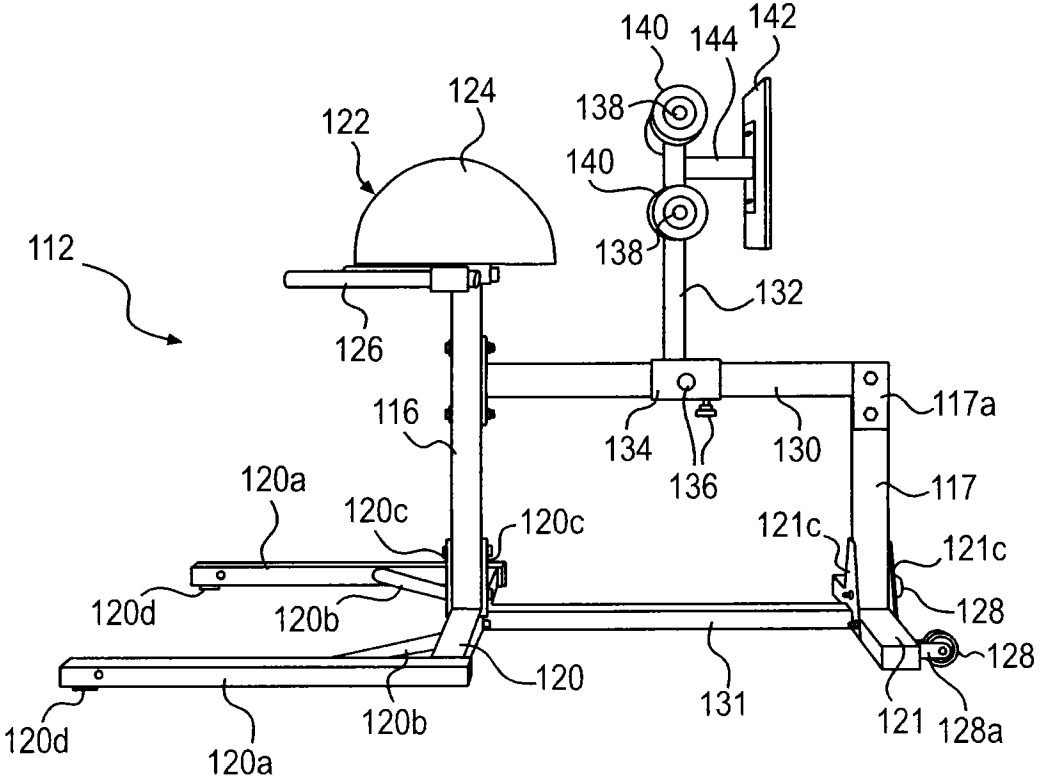
FIG. 13 is a side elevational view of a stand alone exercise device.
Figure 14:
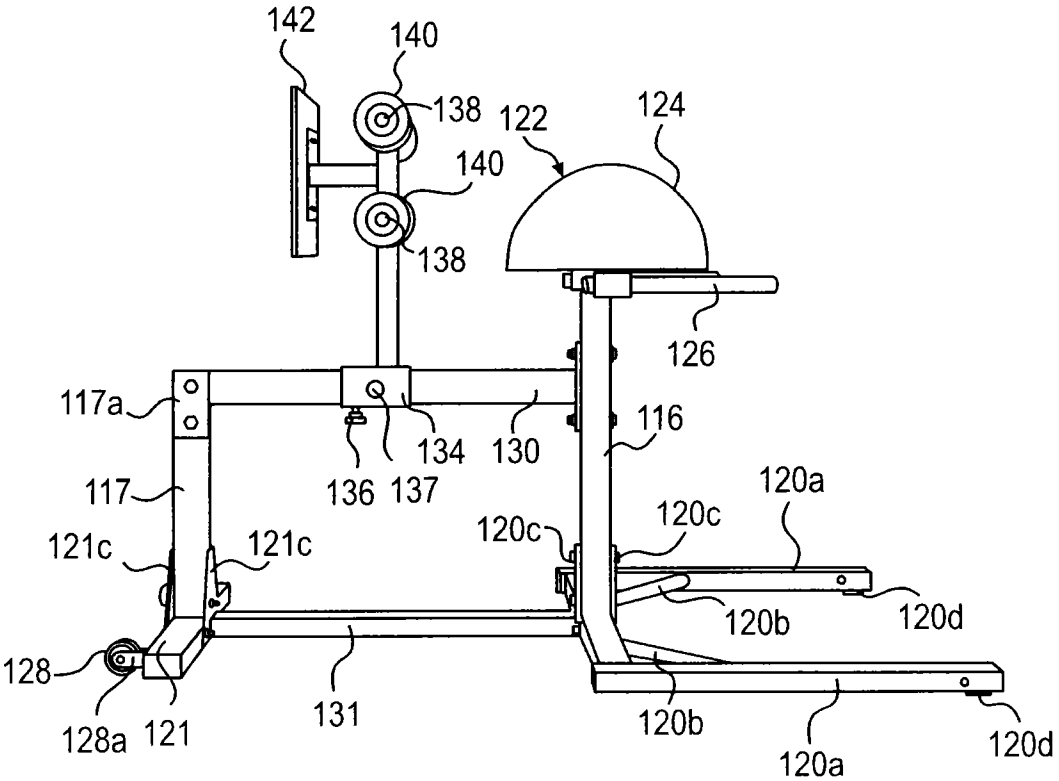
FIG. 14 is an opposite side elevational view of the stand alone exercise device shown in FIG. 13.

As shown in FIG. 13, a third vertical post 117 is connected to the free end of the third horizontal beam 130, for example, by a reinforcing plate 117A and bolts or rivets. A fourth horizontal beam 117 is connected (e.g. by welding, bolting, or mechanical fastener(s)) to the bottom of the third vertical post 117 and oriented transversely relative to the third horizontal beam 130. A pair of sets of trunnions 128A (e.g. plates and axle) are connected to the fourth horizontal beam 121, and support rollers 128 for moving the free standing glute ham exercise device 112 by tilting thereof. A pair of gusset plates 121C can connect the fourth horizontal beam to the third vertical post, and reinforce the structural connection therebetween.

A fifth horizontal beam 131 can connect between the second horizontal beam 120 and the fourth horizontal beam 121 to create a frame arrangement to strengthen the structure of the stand alone glute ham exercise device 112.

Operation

Figure 15:
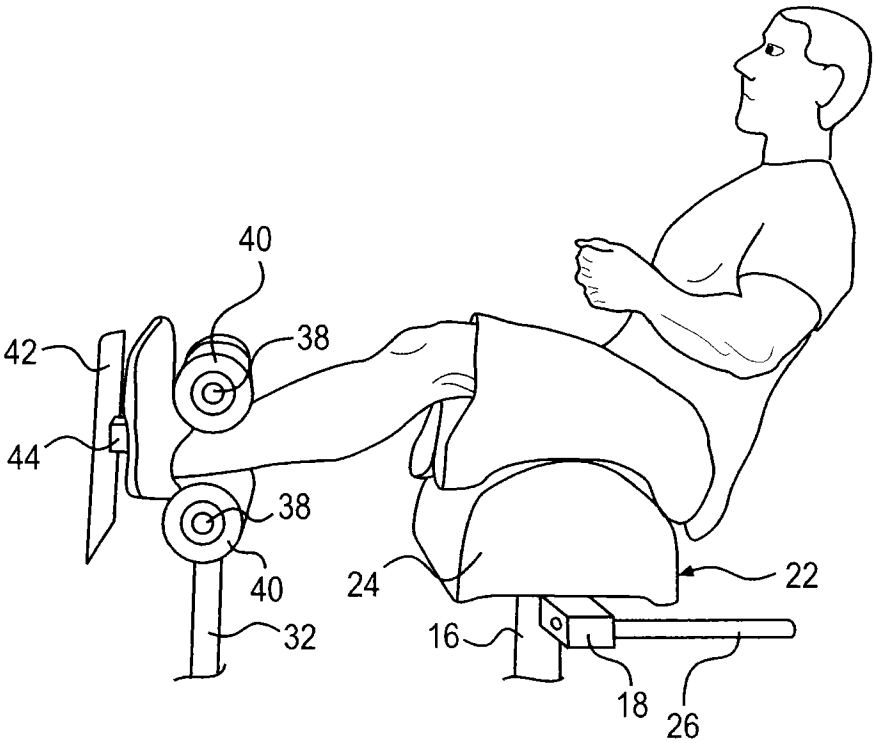
FIG. 15 is a side diagrammatic view illustrating a user in a partial sitting position on the exercise device.
Figure 16:
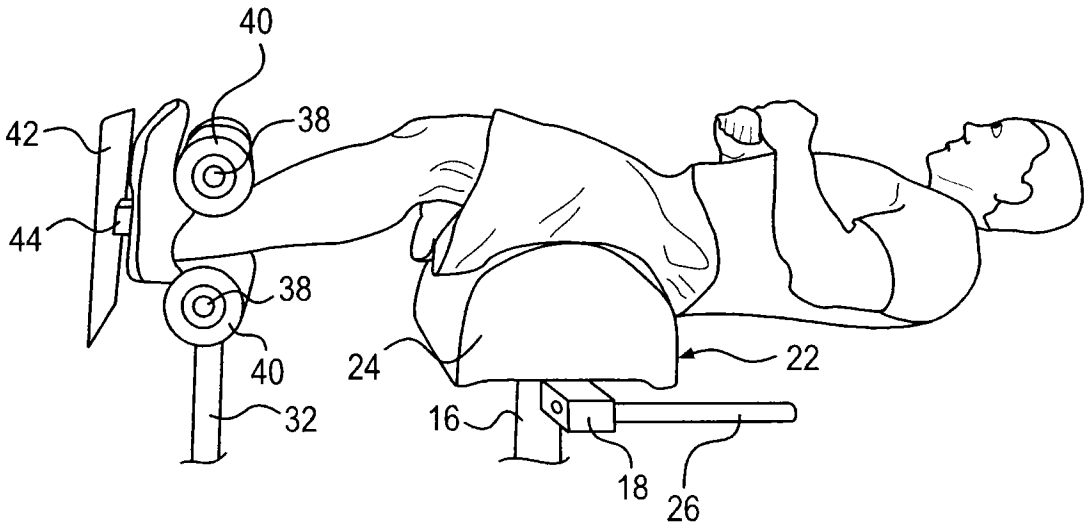
FIG. 16 is a side diagrammatic view illustrating a user in an extended laid out position on the exercise device.
Figure 17:
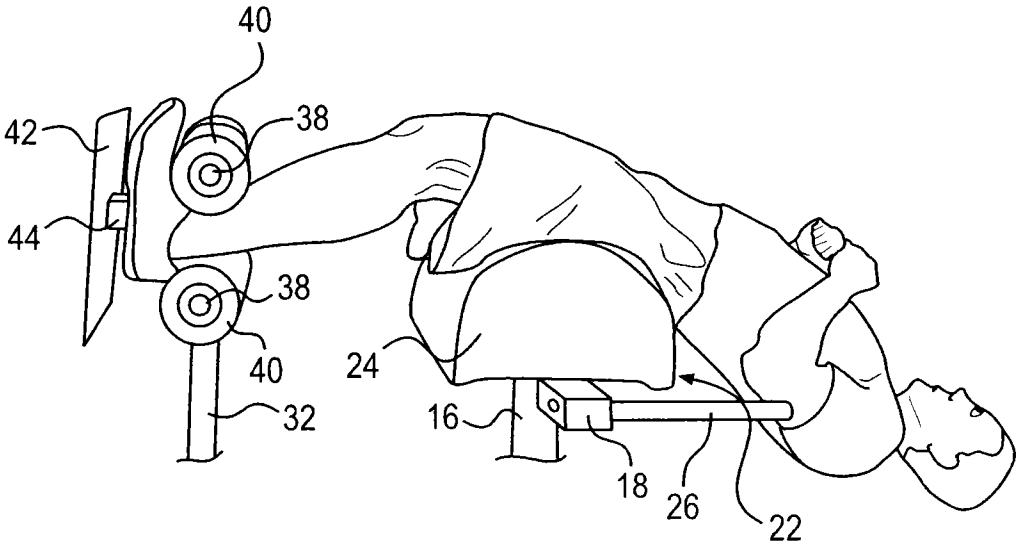
FIG. 17 is a side diagrammatic view illustrating a user in a back extended downwardly position on the exercise device.

The operation and use of the glute ham exercise device 12 (or glute ham exercise device 112) is shown in FIGS. 15 thru 17.

As shown in FIG. 15, a user sits on the split cushion 124, and places his or her ankles between the sets of cushions 40, as shown. The user then leans backwards to the extended horizontal position, as shown in FIG. 16. The user further leans backwards to extend his or her back downward at an angle below horizontal, as shown in FIG. 17. The user then returns to the sitting upward position shown in FIG. 15, and then repeats the entire operation a number of times. The cushion is configured in a manner to allow a user to sit on the cushion, lean backwards to the extended horizontal position, and then further extend his or her back downward at an angle below horizontal.

I claim:

1. A glute ham developer (GHD) exercise device, the device comprising:

a first vertical post located along a center horizontal longitudinal axis of the glute ham developer (GHD) exercise device;

a first horizontal beam connected to and centered on an upper end of the first vertical post and oriented transversely relative to the center horizontal longitudinal axis of the glute ham developer exercise device; and a second horizontal beam connected to and centered on a lower end of the first vertical post and oriented transversely relative to the center horizontal longitudinal axis of the glute ham developer (GHD) exercise device;

a semicylinder-shaped support cushion having a flat base connected to and located above and along the first horizontal beam, a half cylinder curved surface facing upwardly, and flat ends, the semicylinder-shaped support cushion is supported by and centered on the first horizontal beam;

a third horizontal beam connected at a first end to the first vertical post and oriented along the center horizontal longitudinal axis of the glute ham developer (GHD) exercise device;

a second vertical post connected to and directly extending upwardly from the third horizontal beam, the second vertical post being spaced apart from the first vertical post and located along the third horizontal beam;

an ankle grip device connected to the second vertical post, the ankle grip being located above the third horizontal beam of the glute ham developer (GHD) exercise device;

a third vertical post connected to a second end of the third horizontal beam, wherein the first vertical post, the second vertical post, the third vertical post, and the third horizontal beam are located in a same center vertical plane oriented along the center horizontal longitudinal axis of the device, wherein the first horizontal beam, the second horizontal beam, and the first vertical post are located in a same vertical plane oriented transversely relative to the center horizontal longitudinal axis of the device, and wherein the second end of the third horizontal beam is provided with a connector, the connector is a slider for adjusting the position of the connector along a length of the third vertical post.

2. The device according to claim 1, wherein the third vertical post is provided by a second exercise device connected to the glute ham developer (GHD) exercise device.

3. The device according to claim 2, wherein the second exercise device is a rig exercise device comprising spaced apart vertical posts connected together by joist members.

4. The device according to claim 1, wherein the third vertical post is a post of a second exercise device.

5. The device according to claim 4, wherein the second exercise device is a rig exercise device comprising spaced apart vertical posts connected together by joist members.

6. The device according to claim 1, wherein the ankle grip device comprises a pair of shafts that are spaced apart and located at different heights on the second vertical post.

7. The device according to claim 6, wherein each shaft of the ankle support device is fitted with a pair of cushions provided on ends of the shaft.

8. The device according to claim 7, wherein the shafts are spaced apart vertically on the second vertical post in a manner to accommodate the ankles of a user between upper and lower sets of the pair of cushions.

9. The device according to claim 1, further comprising a foot plate connected to the second vertical post by a support.

10. The device according to claim 9, further comprising a support connecting the foot plate a distance from the second vertical post for providing spacing between the ankle grip and the foot plate for accommodating the feet of a user.

11. The device according to claim 1, wherein the second vertical post is connected to the third horizontal beam by a slider to allow adjusting the position of the second vertical post along the third horizontal beam.

12. The device according to claim 1, wherein the support cushion comprises a pair of split cushions connected to the first horizontal beam in a manner to allow the split cushions to be moved closer together or separated further apart.

13. The device according to claim 1, further comprising a set of handles extending outwardly from the first horizontal beam.

14. A glute ham developer (GHD) exercise device, the device comprising:

a first vertical post located along a center horizontal longitudinal axis of the glute ham developer (GHD) exercise device;

a first horizontal beam connected to and centered on an upper end of the first vertical post and oriented transversely relative to the center horizontal longitudinal axis of the glute ham developer (GHD) exercise device;

a second horizontal beam connected to and centered on a lower end of the first vertical post and oriented transversely relative to the center horizontal longitudinal axis of the glute ham developer (GHD) exercise device;

a semicylinder-shaped support cushion having a flat base, the semicylinder-shaped support cushion supported by and centered on the first horizontal beam with a half cylinder surface of the semicylinder-shaped support cushion facing upwardly;

a third horizontal beam connected at one end to the first vertical post and oriented along the center horizontal longitudinal axis of the glute ham developer (GHD) exercise device;

a second vertical post connected to and directly extending upwardly from the third horizontal beam, the second vertical post being spaced apart from the first vertical post and located along the third horizontal beam of the glute ham developer (GHD) exercise device;

an ankle grip device connected to the second vertical post, the ankle grip being located above the center horizontal longitudinal axis of the exercise device;

a third vertical post connected to a second end of third horizontal beam, wherein the first vertical post, the second vertical post, the third vertical post, and the third horizontal beam are located in a same center vertical plane oriented along the center longitudinal horizontal axis of the device, wherein the first horizontal beam, the second horizontal beam, and the first vertical post are located in a same vertical plane oriented transversely relative to the center horizontal longitudinal axis of the device, and wherein the second end of the third horizontal beam is provided with a connector, the connector is a slider for adjusting the position of the connector along a length of the third vertical post.

15. The device according to claim 1, wherein the cushion is supported at a center of the flat base.

16. The device according to claim 15, wherein the first horizontal beam is longer than the cushion.

17. The device according to claim 1, wherein the cushion is configured in a manner to allow a user to sit on the cushion, lean backwards to an extended horizontal position, and then further extend his or her back downward at an angle relative to the extended horizontal position.

18. The device according to claim 1, wherein the second end of the third horizontal beam is provided with a connector for connecting the second end of the third horizontal beam to the third vertical post, the connector being a locking slider configured to allow changing a location of the connector along a length of the third vertical post.

19. A glute ham developer (GHD) exercise device, the device comprising:

a first vertical post located along a center horizontal longitudinal axis of the glute ham developer (GHD) exercise device;

a first horizontal beam connected to and centered on an upper end of the first vertical post and oriented transversely relative to the center horizontal longitudinal axis of the glute ham developer (GHD) exercise device;

a second horizontal beam connected to and centered on a lower end of the first vertical post and oriented transversely relative to the center horizontal longitudinal axis of the glute ham developer (GHD) exercise device;

a semicylinder-shaped support cushion having a flat base connected to and centered on the first horizontal beam and a body engaging half-cylinder surface facing upwardly, the support cushion being located above the center horizontal longitudinal axis of the exercised device, the support cushion being a pair of split cushions oriented transversely relative to the longitudinal axis of the glute ham developer (GHD) exercise device and spaced apart, the pair of split cushions are oriented along the first horizontal beam and transverse relative to the center horizontal longitudinal axis of the glute ham developer (GHD) exercise device;

a third horizontal beam connected at a first end to the first vertical post and oriented along the center horizontal longitudinal axis of the glute ham developer (GHD) exercise device;

a second vertical post connected to and directly extending upwardly from the third horizontal beam, the second vertical post being spaced apart from the first vertical post and located along the third horizontal beam, the second vertical post is provided with a locking slider at a lower end of the second vertical post to allow the spacing between the first vertical post and second vertical post to be changed;

an ankle grip device connected to the second vertical post, the ankle grip being located above the center horizontal longitudinal axis of the glute ham developer (GHD) exercise device, the ankle grip device comprising a pair of shafts that are spaced apart and located at different heights on the second vertical post, the shafts are centered on the second vertical posts, the shafts each having a pair of ends fitted with cushions;

a third vertical post connected to a second end of the third horizontal beam having a connector for connecting the second end of the third horizontal beam to the third vertical post, the connector being provided with a locking slider configured to allow changing a location of the connector along a length of the third vertical post, wherein the first vertical post, the second vertical post, the third vertical post, and the third horizontal beam are located in a same center vertical plane oriented along the center horizontal longitudinal axis of the exercise device, and wherein the first horizontal beam, the second horizontal beam, and the first vertical post are located in a same vertical plane oriented transversely relative to the center longitudinal axis of the exercise device.

20. The device according to claim 19, wherein the pair of split cushions are configured to be moved closer together or separated further apart.

21. The device according to claim 19, wherein the split cushions have flat ends.

22. The device according to claim 21, wherein a flat base of each split cushion is supported by the first horizontal beam.

23. The device according to claim 22, wherein the first horizontal beam supports a center location of each split cushion.

24. A glute ham developer (GHD) exercise device, the device comprising:

a first frame unit, comprising:

a first vertical post located along a center horizontal longitudinal axis of the glute ham developer (GHD) exercise device;

a first horizontal beam connected to and centered on an upper end of the first vertical post and oriented transversely relative to the center horizontal longitudinal axis of the glute ham developer exercise device; and a second horizontal beam connected to and centered on a lower end of the first vertical post and oriented transversely relative to the center horizontal longitudinal axis of the glute ham developer (GHD) exercise device, the first vertical post, wherein the first vertical post, the first horizontal beam, and the second horizontal beam are located in a same vertical plane oriented transversely relative to the center horizontal longitudinal axis of the glute ham developer (GHD) exercise device;

a semicylinder-shaped support cushion having a flat base connected to and located above and along the first horizontal beam, a half cylinder curved surface facing upwardly, and flat ends, the semicylinder-shaped support cushion is supported by and centered on the first horizontal beam; and a second frame unit connected to the first frame unit, the second frame unit comprising:

a third horizontal beam connected at an end to the first vertical post of the first frame unit and oriented along the center horizontal longitudinal axis of the glute ham developer (GHD) exercise device;

a second vertical post connected to and directly extending upwardly from the third horizontal beam, the second vertical post being spaced apart from the first vertical post and located along the third horizontal beam; and a third vertical post connected to an opposite end of the third horizontal beam; and an ankle grip device connected to the second vertical post, the ankle grip being located above the third horizontal beam of the glute ham developer (GHD) exercise device, wherein the first vertical post, the second vertical post, the third vertical post, and the third horizontal beam are located in a same center vertical plane oriented along the center horizontal longitudinal axis of the device, and wherein the second end of the third horizontal beam is provided with a connector, the connector is a slider for adjusting the position of the connector along a length of the third vertical post.

* * * * *